US010234779B2

(12) United States Patent
Ida et al.

(10) Patent No.: US 10,234,779 B2
(45) Date of Patent: Mar. 19, 2019

(54) TONER AND METHOD OF PRODUCING TONER

(71) Applicant: CANON KABUSHIKI KAISHA, Tokyo (JP)

(72) Inventors: Hayato Ida, Toride (JP); Junichi Tamura, Toride (JP); Ryuji Murayama, Nagareyama (JP); Takaho Shibata, Tokyo (JP); Daisuke Yamashita, Tokyo (JP); Takashi Hirasa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/714,926

(22) Filed: Sep. 25, 2017

(65) Prior Publication Data

US 2018/0088478 A1 Mar. 29, 2018

(30) Foreign Application Priority Data

Sep. 28, 2016 (JP) ..... 2016-189381

(51) Int. Cl.
*G03G 9/08* (2006.01)
*G03G 9/087* (2006.01)

(52) U.S. Cl.
CPC ..... *G03G 9/08791* (2013.01); *G03G 9/0804* (2013.01); *G03G 9/08722* (2013.01); *G03G 9/08797* (2013.01)

(58) Field of Classification Search
CPC ..... G03G 9/08791; G03G 9/08797; G03G 9/08722
USPC ..... 430/109.3
See application file for complete search history.

(56) References Cited

U.S. PATENT DOCUMENTS 5,051,331 A * 9/1991 Sakashita ..... G03G 9/08704 430/108.8

FOREIGN PATENT DOCUMENTS

| | | | |
|---|---|---|---|
| JP | 56-13943 | B2 | 4/1981 |
| JP | S5895750 | A | 6/1983 |
| JP | S5918954 | A | 1/1984 |
| JP | S6239428 | B2 | 8/1987 |
| JP | H03150576 | A | 6/1991 |
| JP | H0421860 | A | 1/1992 |
| JP | H04120554 | A | 4/1992 |
| JP | H08184986 | A | 7/1996 |
| JP | H11202555 | A | 7/1999 |
| JP | 2011107261 | A | 6/2011 |

* cited by examiner

*Primary Examiner* — Mark A Chapman
(74) *Attorney, Agent, or Firm* — Canon U.S.A., Inc. IP Division

(57) ABSTRACT

A toner includes a toner particle containing a resin component containing an olefin copolymer, wherein the olefin copolymer includes a specific monomer unit Y1 and a specific monomer unit Y2, and the content of the olefin copolymer in the resin component is more than 50 mass % based on the total mass of the resin component, and the olefin copolymer has a melting point of 80° C. or more and 150° C. or less.

10 Claims, No Drawings

TONER AND METHOD OF PRODUCING TONER

BACKGROUND

Field of the Disclosure

The present disclosure relates to a toner for an electrophotographic system and a method of producing a toner.

Description of the Related Art

In recent years, attempts for further reducing the fixing temperature of a toner in image forming have been tried with an increase in the demand for energy saving. As methods for improving the low-temperature fixability of a toner, Japanese Patent Publication Nos. 56-13943 and 62-39428 and Japanese Patent Laid-Open No. 4-120554 propose techniques involving use of crystalline polyester resins having sharp melt properties showing a considerable reduction in the viscosity when the temperature is increased to a level higher than the melting point.

As other methods, Japanese Patent Laid-Open Nos. 2011-107261, 11-202555, 8-184986, 4-21860, and 3-150576 propose the use of a resin having a low glass transition temperature to reduce the fixing temperature. Japanese Patent Laid-Open Nos. 59-18954 and 58-95750 propose toners containing ester group-containing ethylene copolymers, such as ethylene-vinyl acetate copolymers and ethylene-methyl acrylate copolymers, as the resins having low glass transition temperatures.

SUMMARY

An aspect of the present disclosure provides a toner having excellent low-temperature fixability, hot offset resistance, and charge-retaining property and a method of producing the toner.

An aspect of the present disclosure provides a toner comprising a toner particle containing a resin component, wherein the resin component contains an olefin copolymer, and the olefin copolymer includes a monomer unit Y1 represented by Formula (1), and a monomer unit Y2 represented by Formula (2); such that the content of the olefin copolymer in the resin component is more than 50 mass % based on the total mass of the resin component; and the olefin copolymer has a melting point of 80° C. or more and 150° C. or less.

(1)

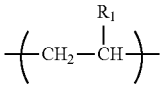

(2)

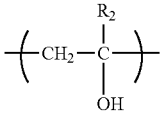

Furthermore, in Formulae (1) and (2), $R_1$ represents H or $CH_3$; and $R_2$ represents H or $CH_3$.

Further features of the present disclosure will become apparent from the following description of exemplary embodiments.

DESCRIPTION OF THE EMBODIMENTS

The use of a crystalline polyester resin for an electrophotographic toner provides excellent low-temperature fixability and high-temperature storage stability due to the sharp melt properties of the resin. However, the crystalline polyester resin has low electrical resistance to impair the charge-retaining property of the toner.

Accordingly, the present inventors focused on copolymers having monomer units derived from olefin compounds, such as ethylene and propylene, as resins having high volume resistance and a glass transition temperature not higher than room temperature.

Specifically, the inventors tried to achieve both excellent low-temperature fixability and charge-retaining property using ethylene(propylene)-acetate copolymers, such as an ethylene-vinyl acetate copolymer; ethylene(propylene)-acrylate copolymers, such as an ethylene-methyl acrylate copolymer; and ethylene(propylene)-methacrylate copolymers, such as an ethylene-methyl methacrylate copolymer.

However, it is difficult to obtain satisfactory low-temperature fixability under high-speed conditions by merely partially adding an ester group-containing olefin copolymer to a toner as proposed in Japanese Patent Laid-Open Nos. 2011-107261, 11-202555, 8-184986, 4-21860, and 3-150576.

In contrast, as described in Japanese Patent Laid-Open Nos. 59-18954 and 58-95750, if such an ester group-containing olefin copolymer is mainly used as the resin of a toner, the hot offset resistance decreases whereas the low-temperature fixability is improved.

The present inventors tried to improve the hot offset resistance by further adding a generally known high molecular weight resin to a toner. However, the hot offset resistance was not improved by further adding a high molecular weight resin of the ester group-containing olefin copolymer, probably due to the low polarity and also the weak intermolecular force of the ester group-containing olefin copolymer. In recent years, multimedia correspondency for corresponding to a variety of recording materials (media), such as postcards, small size paper, envelopes, cardboard, and label paper, is also required. However, in a case where recording materials having different sizes continuously pass through on a fixing member, if a recording material having a smaller size passes through on the fixing member first, the temperature of the portion of the fixing member where no recording material passes through is excessively increased. If a recording material having a larger size then passes through on the fixing member, the toner on the recording material having the larger size is excessively heated, resulting in a risk of occurrence of hot offset. Accordingly, it is desired to improve the hot offset resistance while maintaining the low-temperature fixability, even if a variety of recording materials are used.

In order to increase the hot offset resistance of a toner including an olefin-based material, the present inventors tried to investigate improvement of hot offset resistance by adding hydroxyl groups to the olefin-based material to enhance the cohesion due to intramolecular hydrogen bonding.

Ethylene-poval, which is generally used for food wrapping purpose, was investigated as an olefin resin having hydroxyl groups. The results of the investigation demonstrate that the material improves the hot offset resistance, but gives inferior low-temperature fixability and an insufficient charge-retaining property due to the polarity of the hydroxyl group.

Accordingly, the present inventors further studied and thereby obtained a toner having excellent low-temperature fixability, charge-retaining property, and hot offset resistance by using an olefin copolymer having a melting point of 80° C. or more and 150° C. or less. In addition, microphase separation of the hydroxyl groups having high polarity in the olefin sites having low polarity is caused by controlling the content of the hydroxyl groups of the olefin copolymer and adjusting the melting point to 150° C. or less, leading to further improvement in the charge-retaining property.

Furthermore, the low melting point provides good low-temperature fixability and also high hot offset resistance.

In the present disclosure, the numerical range expressed by the wording "XX or more and YY or less" or "XX to YY" means a numerical range including the lower limit and the upper limit as the extreme points unless otherwise specified.

The term "monomer unit" refers to a reacted form of a monomer substance in a polymer or resin.

The term "crystalline resin" refers to a resin showing an endothermic peak in differential scanning calorimetry (DSC).

The toner of the present disclosure includes a toner particle containing a resin component, wherein the resin component contains an olefin copolymer;

the olefin copolymer including:

a monomer unit Y1 represented by Formula (1), and a monomer unit Y2 represented by Formula (2);

the content of the olefin copolymer in the resin component being more than 50 mass % based on the total mass of the resin component; and the olefin copolymer having a melting point of 80° C. or more and 150° C. or less.

(1)

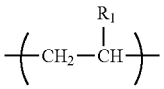

(2)

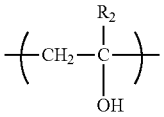

in Formulae (1) and (2), $R_1$ represents H or $CH_3$; and $R_2$ represents H or $CH_3$.

In the present disclosure, the term "resin component" refers to a polymer component mainly contributing to the fixing ability. The resin component includes an olefin copolymer.

In the present disclosure, the olefin copolymer is a polymer having a polyolefin skeleton into which a monomer unit having a hydroxyl group is introduced by, for example, copolymerization. Specifically, the olefin copolymer includes a monomer unit Y1 represented by Formula (1) and a monomer unit Y2 represented by Formula (2).

The monomer unit Y1 represented by Formula (1) and the monomer unit Y2 represented by Formula (2) will now be specifically described.

An olefin copolymer including a monomer unit Y1 represented by Formula (1) where $R_1$ represents H and a monomer unit Y2 represented by Formula (2) where $R_2$ represents H (hereinafter, also referred to as ethylene-poval) can be designed so as to have a low melting point and can be used from the viewpoint of low-temperature fixability.

The resin component may contain one or more such olefin copolymers.

The mass ratio (l+m)/W of the monomer units to the olefin copolymer in the resin component, where W denotes the total mass of the olefin copolymer, 1 denotes the mass of the monomer unit Y1 represented by Formula (1), and m denotes the mass of the monomer unit Y2 represented by Formula (2), is preferably 0.80 or more, more preferably 0.95 or more, and most preferably 1.00, from the viewpoint of low-temperature fixability and charge retention characteristics.

The olefin copolymer may further contain another monomer unit, in addition to the monomer unit Y1 and the monomer unit Y2, within a range that does not impair the effects of the present disclosure. Examples of such additional monomer unit include those represented by Formula (3), (4), or (5).

These monomer units can be introduced into an olefin copolymer by adding the corresponding monomer during the copolymerization for producing the olefin copolymer or by modifying the olefin copolymer through a polymer reaction.

(3)

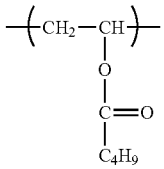

(4)

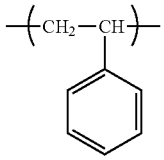

(5)

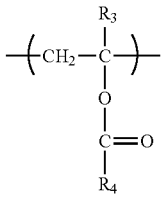

in Formula (5), $R_3$ represents H or $CH_3$; and $R_4$ represents $CH_3$ or $C_2H_5$.

From the viewpoint of low-temperature fixability, the content of the olefin copolymer in the resin component is preferably more than 50 mass %, preferably 70 mass % or more, based on the total mass of the resin component.

When the content of the olefin copolymer in the resin component is higher than 50 mass %, the low-temperature fixability is improved.

From the viewpoint of low-temperature fixability, charge-retaining property, and hot offset resistance, the content of the monomer unit Y2 is preferably 2.0 mass % or more and 20.0 mass % or less and more preferably 2.0 mass % or more and 10.0 mass % or less based on the total mass of the olefin copolymer.

The melting point of the olefin copolymer decreases by controlling the content of the monomer unit Y2 to 20.0 mass % or less, resulting in further improvements in the low-temperature fixability and the charge-retaining property of the toner.

In addition, by controlling the content of the monomer unit Y2 to 2.0 mass % or more, the interaction of the intermolecular hydrogen bond due to hydroxyl groups improves the hot offset resistance.

The masses [1] and [m] of the monomer units represented by the above-mentioned formulae and the content of the monomer unit Y2 can be measured by usual analytical procedures.

For example, procedures, such as a nuclear magnetic resonance ($^1$H-NMR) method and pyrolysis gas chromatography, can be employed.

A method of measurement by $^1$H-NMR will now be described.

The content rates of the monomer units represented by Formula (1) or (2) can be calculated by, for example, comparing the integral values of the hydrogen atoms of the alkylene groups in the monomer unit represented by Formula (1) and the hydrogen atoms of the methine groups to which the hydroxyl groups of the monomer unit represented by Formula (2) bind.

Specifically, the content rate of each monomer unit in an ethylene-poval copolymer can be calculated by the following method.

About 5 mg of a sample is dissolved in 0.5 mL of deuterated dimethylsulfoxide (DMSO) containing tetramethylsilane serving as an internal standard of 0.00 ppm and tetrafluoroacetic acid (TFA) serving as an additive. The resulting solution is put in a test tube, and a $^1$H-NMR spectrum of the solution is measured under conditions of a repetition time of 2.7 seconds and a cumulated number of 16 times.

The peak of 1.1 to 1.4 ppm corresponds to $CH_2$—$CH_2$ of the monomer unit derived from ethylene; and the peak near 3.0 to 4.0 ppm corresponds to CH of the monomer unit derived from vinyl alcohol. The ratio of the integral values of these peaks is calculated to determine the content rate of each monomer unit.

The olefin copolymer has a melting point of 80° C. or more and 150° C. or less.

From the viewpoint of durability of the toner, the melting point is 80° C. or more and preferably 90° C. or more. At the same time, from the viewpoint of low-temperature fixability, the melting point is 150° C. or less, preferably 130° C. or less, and more preferably 110° C. or less.

The charge-retaining property is improved by controlling the melting point to 150° C. or less.

Its reason is unclear, but it is believed as follows: A reduction in the melting point decreases the amount of hydroxyl groups in the resin, and microphase separation of the hydroxyl groups occurs in the olefin sites to suppress the mobility of the hydroxyl groups. The melting point of an olefin copolymer can be controlled by, for example, the content of the monomer unit (i.e., monomer unit Y2) having a hydroxyl group.

The olefin copolymer preferably has a softening point (Tm) of 100° C. or more and 150° C. or less from the viewpoint of enduring the shock and pressure during the use of the toner.

The softening point (Tm) can be controlled by modifying the molecular weight of the olefin copolymer and can be raised by increasing the molecular weight.

In the present disclosure, the softening point (Tm) is measured with a capillary rheometer of a load extrusion system "Flow Characteristics Evaluation Apparatus Flow Tester CFT-500D" (manufactured by Shimadzu Corporation) in accordance with the manual provided with the apparatus.

In this apparatus, the measurement sample in a cylinder is melted by increasing the temperature while applying a predetermined load to the measurement sample from the top with a piston, and the melted measurement sample is extruded from a die at the bottom of the cylinder. A rheogram can be created from the amount (mm) of descent of the piston and the temperature (° C.) in this process.

In the present disclosure, "the ½ method melting temperature" described in the manual provided with the "Flow Characteristics Evaluation Apparatus Flow Tester CFT-500D" is used as the softening point.

The ½ method melting temperature is calculated as follows.

A half of the difference between the amount of descent of the piston at the time when the outflow is over (referred to as outflow end point, Smax) and the amount of descent of the piston at the time when the outflow is started (referred to as minimum point, Smin) is determined and is referred to as X ($X=(Smax-Smin)/2$). In the rheogram, the temperature when the amount of descent of the piston is equal to the sum of the values X and Smin is defined as the ½ method melting temperature.

Under an environment at a temperature of 25° C., 1.2 g of a sample is compressively molded into a cylindrical shape having a diameter of 8 mm with a tablet compression molder (e.g., a standard manual Newton Press NT-100H, manufactured by NPa SYSTEM Co., Ltd.) at 10 MPa for 60 seconds.

The specific measurement operation is carried out in accordance with the manual provided with the apparatus.

The conditions for measurement with CFT-500D are as follows.

Test mode: rising temperature method
Starting temperature: 60° C.
Reaching temperature: 200° C.
Measurement interval: 1.0° C.
Temperature rising rate: 4.0° C./min
Piston cross-sectional area: 1.000 $cm^2$
Test load (piston load): 5.0 kgf
Preheating time: 300 seconds
Diameter of die orifice: 1.0 mm
Die length: 1.0 mm The olefin copolymer may be produced by any method and is produced, for example, from the easiness of production, by hydrolysis of an ethylene-vinyl acetate copolymer.

Specifically, an ethylene-vinyl acetate copolymer of which the monomer unit content derived from vinyl acetate is 4 mass % or more and 34 mass % or less is refluxed in a solvent mixture of toluene and ethanol by using sodium hydroxide at 90° C.

The resin component may further contain an acid group-containing olefin copolymer.

The acid group-containing olefin copolymer is a resin prepared by random copolymerization, block copolymerization, or graft copolymerization of an acid group-containing component with a main component polyolefin, such as polyethylene and polypropylene, or a modification product of such a resin by a polymer reaction. Examples of the acid group-containing component include acrylic acid, methacrylic acid, maleic acid, maleic anhydride, itaconic acid, and vinyl sulfonate.

The resin component may include another component within a range that does not affect the physical properties, in addition to the polyolefin and the acid group-containing component.

The content of the monomer unit derived from the component other than the polyolefin and the acid group-containing component in the acid group-containing olefin copolymer is preferably 20 mass % or less, more preferably 10 mass % or less, more preferably 5 mass % or less, and most preferably substantially 0 mass %, from the viewpoint of the high-temperature storage stability of the toner.

A copolymer of the main component polyethylene and an acid group-containing component can be used from the viewpoint of low-temperature fixability.

Furthermore, the acid group-containing component can be acrylic acid or methacrylic acid from the viewpoint of adhesiveness between the toner and paper. For example, an ethylene-acrylic acid copolymer and an ethylene-methacrylic acid copolymer can be used from the viewpoint of improving the low-temperature fixability, high-temperature storage stability, and adhesiveness.

The acid group-containing olefin copolymer preferably has an acid value of 50 mg KOH/g or more and 300 mg KOH/g or less and more preferably 80 mg KOH/g or more and 200 mg KOH/g or less. Sufficient adhesiveness to paper is provided by controlling the acid value to 50 mg KOH/g or more, and the chargeability is further improved by controlling the acid value to 300 mg KOH/g or less.

When the resin component containing the acid group-containing olefin copolymer within the above-mentioned range, the carboxyl group of the acid group-containing olefin copolymer forms a hydrogen bond with the hydroxyl group on the surface of paper to enhance the adhesiveness between the toner and paper, resulting in prevention of the fixed object from being deleted with, for example, an eraser.

In production of the toner particles by emulsion aggregation described below, if the resin component contains the acid group-containing olefin copolymer, the cohesiveness can be readily controlled to give good particle size distribution of the toner particles.

The content of the acid group-containing olefin copolymer is preferably 10 mass % or more and less than 50 mass % and more preferably 10 mass % or more and 30 mass % or less based on the total mass of the resin component. The content within this range can improve the adhesiveness with paper while preventing the chargeability from varying depending on the environment.

The acid value is the number of milligrams of potassium hydroxide necessary for neutralizing the acid components, such as free fatty acid and resin acid, contained in 1 g of a sample. The acid value is measured in accordance with JIS K 0070-1992, specifically, according to the following procedure.

(1) Preparation of Reagent

Phenolphthalein (1.0 g) was dissolved in ethyl alcohol (95 vol %, 90 mL), and deionized water is added to the mixture to make 100 mL of a phenolphthalein solution.

Special grade potassium hydroxide (7 g) is dissolved in water (5 mL), and ethyl alcohol (95 vol %) is added thereto to make 1 L of a solution. The solution is put in an alkali-resistant container not to be in contact with carbon dioxide and so on, is left to stand for 3 days, and is then filtered to prepare a potassium hydroxide solution. The resulting potassium hydroxide solution is stored in an alkali-resistant container. The factor of the potassium hydroxide solution is determined through titration by putting 25 mL of 0.1 mol/L hydrochloric acid in a conical flask, adding several drops of the phenolphthalein solution prepared above to the flask, and determining the amount of the potassium hydroxide solution used for neutralization. The 0.1 mol/L hydrochloric acid is produced in accordance with JIS K 8001-1998.

(2) Operation (A) Actual Test

The sample is pulverized, and 2.0 g thereof is precisely weighed in a 200-mL conical flask. A solution mixture (100 mL) of toluene and ethanol (2:1) is added to the flask to dissolve the sample over 5 hours. Subsequently, several drops of the phenolphthalein solution as an indicator are added to the flask, and the sample is titrated with the potassium hydroxide solution. The end point of the titration is determined when the faint red color of the indicator continues for about 30 seconds.

(B) Blank Test

The same operation and titration as above, except that the sample is not used (i.e., using only a solution mixture of toluene and ethanol (2:1)), are performed.

(3) Acid Value

The acid value is calculated by substituting the results into the following expression:

$$A=[(C-B)\times f\times 5.61]/S$$

where, A represents the acid value (mg KOH/g); B represents the amount (mL) of the potassium hydroxide solution used in the blank test; C represents the amount (mL) of the potassium hydroxide solution used in the actual test; f represents the factor of the potassium hydroxide solution; and S represents the amount (g) of the sample.

The acid group-containing olefin copolymer preferably has a softening point of 100° C. or more and 140° C. or less from the viewpoint of blocking resistance, adhesiveness between the toner and paper, and compatibility with the olefin copolymer.

The acid group-containing olefin copolymer preferably has a melting point of 50° C. or more and 100° C. or less and more preferably 50° C. or more and 90° C. or less from the viewpoint of low-temperature fixability and high-temperature storage stability.

In the present disclosure, the melting point can be measured with a differential scanning calorimeter (DSC).

Specifically, 0.01 to 0.02 g of a sample is precisely weighed in an aluminum pan, and the temperature is raised at a heating rate of 10° C./min from 0° C. to 200° C. to obtain a DSC curve.

The peak temperature of the maximum endothermic peak in the resulting DSC curve is defined as the melting point.

The olefin copolymer preferably has a rupture elongation of 300% or more and more preferably 500% or more. A rupture elongation of 300% or more provides good bending resistance to the fixed object. The upper limit of the rupture elongation is about 1000% or less.

The rupture elongation is measured under conditions based on JIS K 7162.

If the resin component contains a plurality of olefin copolymers, the rupture elongation is measured under the same conditions as above after melt mixing.

The resin component may contain another polymer or resin in a range that does not impair the effects of the present disclosure, in addition to the olefin copolymer and the acid group-containing olefin copolymer.

Specifically, examples of such polymer or resin include homopolymers of styrene and its substitutes, such as polystyrene, poly-p-chlorostyrene, and polyvinyltoluene; styrenic copolymers, such as a styrene-p-chlorostyrene copolymer, a styrene-vinyltoluene copolymer, a styrene-vinylnaphthalene copolymer, a styrene-acrylate copolymer, and a styrene-methacrylate copolymer; poly(vinyl chloride); phenolic resins; natural resin modified phenolic resins; natural resin modified maleic acid resins; acrylic resins; methacrylic resins; poly(vinyl acetate); silicone resins; polyester resins; polyurethane resins; polyamide resins; furan resins; epoxy resins; xylene resins; polyethylene resins; and polypropylene resins.

The toner particles can include a low molecular weight plasticizer having a melting point of 50° C. or more and 100° C. or less. The low molecular weight plasticizer can be an aliphatic hydrocarbon or its derivative in order to be compatible with the olefin copolymer and to have a melting point of 50° C. or more and 100° C. or less.

Specifically, examples of the low molecular weight plasticizer include aliphatic hydrocarbons having 20 to 60 carbon atoms, such as hexacosane, triacontane, and hexatriacontane; aliphatic alcohols, such as docosanol; and aliphatic carboxylic acids, such as stearic acid.

From the viewpoint of compatibility with the olefin copolymer and low-temperature fixability, aliphatic alcohols and aliphatic carboxylic acids can be used. From the viewpoint of the charge-retaining property, aliphatic hydrocarbons can be used.

The use of the low molecular weight plasticizer can plasticize the olefin copolymer forming a matrix during heat fixing of the toner to enhance the low-temperature fixability. The low molecular weight plasticizer can also function as a crystal nucleating agent for the olefin copolymer. Accordingly, the micromobility of the hydroxyl group-containing olefin copolymer is suppressed, resulting in an improvement in the charge-retaining property.

The content of the low molecular weight plasticizer is preferably 1 part by mass or more and 40 parts by mass or less, more preferably 10 parts by mass or more and 35 parts by mass or less, and most preferably 10 parts by mass or more and 30 parts by mass or less based on 100 parts by mass of the resin component.

The toner particles may contain silicone oil as a release agent.

The release agents that are usually used in toners, such as alkyl waxes, are highly compatible with the olefin copolymer to hardly exhibit the releasing effect.

When the toner particles contain a coloring agent, the addition of silicone oil can improve the dispersibility of the coloring agent, leading to easy formation of high density images.

Examples of the silicone oil include dimethyl silicone oil, methyl phenyl silicone oil, methyl hydrogen silicone oil, amino-modified silicone oil, carboxy-modified silicone oil, alkyl-modified silicone oil, and fluorine-modified silicone oil.

The silicone oil preferably has a viscosity of 5 $mm^2/s$ or more and 1000 $mm^2/s$ or less and more preferably 20 $mm^2/s$ or more and 1000 $mm^2/s$ or less. The content of the silicone oil is preferably 1 part by mass or more and 20 parts by mass or less and more preferably 5 parts by mass or more and 20 parts by mass or less based on 100 parts by mass of the resin component from the viewpoint of achieving good releasability while preventing a reduction in flowability.

The toner particles may contain a coloring agent. Examples of the coloring agent include the followings.

Black coloring agent: Examples of the black coloring agent include carbon black; magnetic materials; and coloring agents toned to black with yellow coloring agents, magenta coloring agents, and cyan coloring agents.

The coloring agents may be pigments only, but combinations of dyes and pigments can enhance the definition and thereby can form high-quality full-color images.

Magenta toner pigment: Examples of the magenta toner pigment include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Reds 1, 2, 10, 13, 15, 23, 29, and 35.

Magenta toner dye: Examples of the magenta toner dye include oil-soluble dyes, such as C.I. Solvent Reds 1, 3, 8, 23, 24, 25, 27, 30, 49, 81, 82, 83, 84, 100, 109, and 121; C.I. Disperse Red 9; C.I. Solvent Violets 8, 13, 14, 21, and 27; and C.I. Disperse Violet 1, and include basic dyes, such as C.I. Basic Reds 1, 2, 9, 12, 13, 14, 15, 17, 18, 22, 23, 24, 27, 29, 32, 34, 35, 36, 37, 38, 39, and 40; and C.I. Basic Violets 1, 3, 7, 10, 14, 15, 21, 25, 26, 27, and 28.

Cyan toner pigment: Examples of the cyan toner pigment include C.I. Pigment Blues 2, 3, 15:2, 15:3, 15:4, 16, and 17; C.I. Vat Blue 6; C.I. Acid Blue 45; and copper phthalocyanine pigments having phthalocyanine skeletons substituted with one to five phthalimide methyl groups.

Cyan toner dye: Examples of the cyan toner dye include C.I. Solvent Blue 70.

Yellow toner pigment: Examples of the yellow toner pigment include C.I. Pigment Yellows 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellows 1, 3, and 20.

Yellow toner dye: Examples of the yellow toner dye include C.I. Solvent Yellow 162.

These coloring agents can be used alone, as a mixture, or in a form of a solid solution. The coloring agent is selected from the points of hue angle, color saturation, brightness, light resistance, OHP transparency, and dispersibility in the toner.

The content of the coloring agent is preferably 1 part by mass or more and 20 parts by mass or less based on 100 parts by mass of the resin component.

The toner preferably has a volume median diameter of 3.0 μm or more and 10.0 μm or less and more preferably 4.0 μm or more and 7.0 μm or less from the viewpoint of forming high-definition images.

The volume median diameter of the toner may be measured with a particle size distribution analyzer (Coulter Multisizer III: manufactured by Coulter Corporation) by a Coulter method.

The method of producing a toner of the present disclosure produces a toner including a toner particle containing a resin component, wherein the resin component contains an olefin copolymer; and the method includes a preparation step of preparing a resin fine particle dispersion in which resin fine particles generating the resin component are dispersed in an aqueous medium, wherein the olefin copolymer includes:

a monomer unit Y1 represented by Formula (1), and a monomer unit Y2 represented by Formula (2);

the content of the olefin copolymer in the resin component is more than 50 mass % based on the total mass of the resin component; and the olefin copolymer has a melting point of 80° C. or more and 150° C. or less.

The method of producing a toner including the toner particle includes a preparation step of preparing a resin fine particle dispersion in which rein fine particles generating a resin component are dispersed in an aqueous medium.

Among the methods of producing toner particles in an aqueous medium, in particular, a method involving emulsion aggregation can be used. In the emulsion aggregation, a dispersion of resin fine particles having a sufficiently small diameter compared to the target particle diameter is prepared in advance, and the resin fine particles are aggregated in an aqueous medium to produce to particles.

The emulsion aggregation can include, after the preparation step of preparing a resin fine particle dispersion, an aggregation step of aggregating the resin fine particles to form aggregated particles and a fusion step of heating the aggregated particles for fusion.

Furthermore, in addition to the above-mentioned steps, for example, a cooling step, a washing step, and a drying step may be performed.

A method of producing a toner involving emulsion aggregation will now be specifically described, but the method is not limited thereto.

Preparation Step of Preparing Resin Fine Particle Dispersion

The resin fine particle dispersion can be prepared by a known method and can be prepared by, for example, the following method.

For example, an olefin copolymer is dissolved in an organic solvent to form a uniform solution. A basic compound and a surfactant are then optionally added to the solution. An aqueous medium is further added to the solution to form fine particles. Lastly, the organic solvent is removed to produce a resin fine particle dispersion in which resin fine particles are dispersed.

Alternatively, the resin fine particle dispersion may be formed by co-emulsification involving simultaneous addition, dissolution, and emulsification of an olefin copolymer and an acid group-containing olefin copolymer in an organic solvent.

When the resin fine particles are formed by co-emulsification with the acid group-containing olefin copolymer, the olefin copolymer and the acid group-containing olefin copolymer are uniformly mixed with each other in the organic phase to further increase the compatibility of the both copolymers in the toner particles, resulting in enhancement of adhesiveness between the toner and paper. More specifically, the olefin copolymer and the acid group-containing olefin copolymer are heated and dissolved in an organic solvent, and a surfactant and a basic compound are added thereto. Subsequently, an aqueous medium is gradually added to the solution with applying shear with, for example, a homogenizer to produce a resin-containing co-emulsion (resin fine particle dispersion).

Alternatively, after addition of the aqueous medium, shear is applied with, for example, a homogenizer to produce a resin-containing co-emulsion. Subsequently, the organic solvent is removed by heating or reducing the pressure to produce a resin fine particle dispersion.

When the resin fine particle dispersion is prepared, the amount of the resin component to be dissolved in an organic solvent is preferably 10 parts by mass or more and 50 parts by mass or less and more preferably 30 parts by mass or more and 50 parts by mass or less based on 100 parts by mass of the organic solvent.

The organic solvent may be any solvent that can dissolve the resin component and can be a solvent having a high solubility for the olefin copolymer, such as toluene, xylene, and ethyl acetate.

The surfactant may be any surfactant, and examples thereof include anionic surfactants, such as sulfate, sulfonate, carboxylate, phosphate, and soap surfactants; cationic surfactants, such as amine salt and quaternary ammonium salt surfactants; and nonionic surfactants, such as polyethylene glycol, alkylphenol-ethylene oxide adduct, and polyhydric alcohol surfactants.

Examples of the basic compound include inorganic bases, such as sodium hydroxide and potassium hydroxide; and organic bases, such as triethylamine, trimethylamine, dimethylaminoethanol, and diethylaminoethanol. The basic compounds may be used alone or in combination of two or more thereof.

The resin fine particles preferably have a volume median diameter of 0.05 μm or more and 1.00 μm or less and more preferably 0.10 μm or more and 0.60 μm or less. When the median diameter is within this range, toner particles having a desired particle diameter can be readily prepared.

The volume median diameter may be measured with a dynamic light scattering particle size analyzer (Nanotrac UPA-EX150: manufactured by Nikkiso Co., Ltd.).

Aggregation Step

In the aggregation step, for example, the resin fine particle dispersion is mixed with a coloring agent fine particle dispersion, an aliphatic hydrocarbon fine particle dispersion, and a silicone oil emulsion to prepare a mixture solution. The fine particles contained in the prepared mixture solution are then aggregated to form aggregated particles.

The aggregated particles can be formed by, for example, adding a flocculant to the mixture solution and then mixing and heating the mixture or appropriately applying a mechanical power or the like to the mixture solution.

The coloring agent fine particle dispersion is prepared by dispersing the above-mentioned coloring agent. The coloring agent fine particles are dispersed by a known method. For example, a rotational shear-type homogenizer; a media-type disperser, such as a ball mill, sand mill, or attritor; or a high-pressure counter collision-type disperser can be used. In addition, a surfactant or polymer dispersant for providing dispersion stability can be optionally added to the dispersion.

The aliphatic hydrocarbon fine particle dispersion and the silicone oil emulsion are each prepared by dispersing each material in an aqueous medium. Each material is dispersed by a known method. For example, a rotational shear-type homogenizer; a media-type disperser, such as a ball mill, sand mill, or attritor; or a high-pressure counter collision-type disperser can be used. In addition, a surfactant or polymer dispersant for providing dispersion stability can be optionally added to the dispersion or the emulsion.

Examples of the flocculant include salts of monovalent metals such as sodium and potassium; salts of divalent metals such as calcium and magnesium; salts of trivalent metals such as iron and aluminum; and polyvalent metal salts, such as polychlorinated aluminum. From the viewpoint of particle diameter controllability in the aggregation step, divalent metal salts, such as calcium chloride and magnesium sulfate, can be used.

Addition and mixing of the flocculant can be performed in a temperature range of room temperature to 75° C. By performing mixing under this temperature condition, the aggregation stably progresses. The mixing can be performed with a known mixing apparatus, such as a homogenizer or mixer.

The aggregated particles formed in the aggregation step may have any volume median diameter and, in general, may be controlled to about 4.0 μm or more and 7.0 μm or less so as to be similar to the median diameter of target toner particles. The particle diameter can be readily controlled by, for example, appropriately setting and changing the temperature at the time of addition and mixing of the flocculant and other agents and the mixing and stirring conditions.

The volume median diameter of the aggregated particles may be measured with a particle size distribution analyzer (Coulter Multisizer III: manufactured by Coulter Corporation) by a Coulter method.

Fusion Step

In the fusion step, the aggregated particles are heated and fused to produce particles having smoothened surfaces from the aggregated particles.

Before a primary fusion step, a chelating agent, a pH adjuster, a surfactant, and other additives can be appropriately added to the medium of the aggregated particles in order to prevent melt-adhesion between the resulting resin particles.

Examples of the chelating agent include ethylenediaminetetraacetic acid (EDTA) and its alkali metal salts, such as Na salts; and sodium gluconate, sodium tartrate, potassium citrate, sodium citrate, nitrotriacetate (NTA) salts, and many water-soluble polymers (polymer electrolytes) containing both of COOH and OH functional groups.

The heating temperature can be not lower than the melting points of the olefin copolymer or the low molecular weight plasticizer contained in the aggregated particles. The upper limit of the heating temperature is, for example, about the temperature causing pyrolysis of the olefin copolymer or the low molecular weight plasticizer.

The time of the heating and fusing is short when the heating temperature is high and is long when the heating temperature is low. That is, the time of the heating and fusing varies depending on the heating temperature and cannot be uniformly defined, but is generally about 10 minutes or more and 10 hours or less.

Cooling Step

In the cooling step, the aqueous medium containing the resin particles prepared in the fusion step may be cooled to a temperature lower than the crystallization temperature of the olefin copolymer.

Cooling to a temperature lower than the crystallization temperature can prevent generation of coarse particles. Specifically, the cooling rate is 0.1° C. to 50° C./min.

Furthermore, annealing can be performed for accelerating the crystallization by maintaining the olefin copolymer to a temperature giving a high crystallization speed during the cooling or after the cooling. The crystallization is accelerated by maintaining the olefin copolymer at a temperature of 30° C. to 70° C. As a result, the blocking resistance of the toner is further improved.

Washing Step

Impurities in the resin particles produced through the above-described steps can be removed by repeating washing and filtration.

Specifically, the resin particles can be washed with an aqueous solution containing a chelating agent, such as ethylenediaminetetraacetic acid (EDTA) or its sodium salt, and further with pure water. Metal salts, surfactants, and other impurities in the resin particles can be removed by repeating washing with pure water and filtration several times. The number of times of filtration is preferably 3 to 20 times and more preferably 3 to 10 times from the point of manufacturing efficiency.

Drying Step

The washed resin particles may be dried to obtain toner particles.

The toner particles may be directly used as a toner. Alternatively, inorganic fine particles, such as silica, alumina, titania, or calcium carbonate, or resin fine particles, such as vinyl resin, polyester resin, or silicone resin particles, in a dry state may be optionally added to the toner particles with applying a shearing force to form a toner. The inorganic fine particles and the resin fine particles function as external additives, such as a flowability auxiliary and a cleaning auxiliary.

EXAMPLES

The present disclosure will now be described in further detail by Examples and Comparative Examples, which are not intended to limit the disclosure. Note that the terms "part(s)" and "%" in Examples and Comparative Examples are based on mass, unless otherwise specified.

Example of Production of Olefin Copolymer EVOH-A

Ethylene-vinyl acetate copolymer A (100 parts, content of monomer unit derived from vinyl acetate: 15 mass %, acid value: 0 mg KOH/g, weight-average molecular weight: 110000, softening point (Tm): 128° C., melting point: 86° C., rupture elongation: 700%) was dissolved in a solvent mixture of toluene (500 mL) and ethanol (500 mL) at 90° C.

Subsequently, sodium hydroxide (10 parts) was added to the solution, followed by reflux for 6 hours and then washing with ethanol to give EVOH-A (ethylene-poval copolymer, i.e., olefin copolymer). Table 1 shows the physical properties of the resulting copolymer.

Example of Production of Olefin Copolymer EVOH-B

EVOH-B was produced as in the production of EVOH-A except that ethylene-vinyl acetate copolymer B (content of monomer unit derived from vinyl acetate: 28 mass %, acid value: 0 mg KOH/g, Tm: 115° C., melting point: 69° C., rupture elongation: 800%) was used instead of ethylene-vinyl acetate copolymer A.

Example of Production of Olefin Copolymer EVOH-C

EVOH-C was produced as in the production of EVOH-A except that ethylene-vinyl acetate copolymer C (content of monomer unit derived from vinyl acetate: 15 mass %, acid value: 0 mg KOH/g, Tm: 98° C., melting point: 81° C., rupture elongation: 500%) was used instead of ethylene-vinyl acetate copolymer A.

Example of Production of Olefin Copolymer EVOH-D

EVOH-D was produced as in the production of EVOH-A except that ethylene-vinyl acetate copolymer D (content of monomer unit derived from vinyl acetate: 15 mass %, acid value: 0 mg KOH/g, Tm: 155° C., melting point: 89° C., rupture elongation: 800%) was used instead of ethylene-vinyl acetate copolymer A.

Example of Production of Olefin Copolymer EVOH-E

EVOH-E was produced as in the production of EVOH-A except that ethylene-vinyl acetate copolymer E (content of monomer unit derived from vinyl acetate: 5 mass %, acid value: 0 mg KOH/g, Tm: 140° C., melting point: 105° C., rupture elongation: 700%) was used instead of ethylene-vinyl acetate copolymer A.

Example of Production of Olefin Copolymer EVOH-F

EVOH-F was produced as in the production of EVOH-A except that ethylene-vinyl acetate copolymer F (content of monomer unit derived from vinyl acetate: 3 mass %, acid value: 0 mg KOH/g, Tm: 138° C., melting point: 110° C., rupture elongation: 800%) was used instead of ethylene-vinyl acetate copolymer A.

Example of Production of Resin Fine Particle 1 Dispersion

The following components:

toluene (manufactured by Wako Pure Chemical Industries, Ltd.): 300 parts,

EVOH-A: 100 parts, and an acid group-containing olefin copolymer (ethylene-methacrylic acid copolymer, softening point: 120° C., melt flow rate: 60 g/10 min, melting point: 90° C., acid value: 90 mg KOH/g): 25 parts were mixed and dissolved at 90° C.

Separately, sodium dodecylbenzenesulfonate (0.7 parts), sodium laurate (1.5 parts), and N,N-dimethylaminoethanol (0.8 parts) were added to deionized water (700 parts) and were dissolved with heating at 90° C.

Subsequently, this aqueous solution was mixed with the toluene solution prepared above. The mixture was stirred at 7000 rpm with an ultrahigh-speed stirring device T.K. Robomix (manufactured by Primix Corporation).

The mixture was further emulsified with a high-pressure impact disperser Nanomizer (manufactured by Yoshida Kikai Co., Ltd.) at a pressure of 200 MPa.

Subsequently, the toluene was removed with an evaporator, and the concentration was adjusted with deionized water to give an aqueous dispersion (resin fine particle 1 dispersion) having a resin fine particle 1 concentration of 20%.

The resin fine particle 1 had a volume median diameter of 0.50 μm measured with a dynamic light scattering particle size analyzer (Nanotrac, manufactured by Nikkiso Co., Ltd.).

Example of Production of Resin Fine Particle 2 Dispersion

A resin fine particle 2 dispersion was prepared as in the production of the resin fine particle 1 dispersion, except that EVOH-A was replaced by EVOH-B. The resulting resin fine particle 2 had a volume median diameter of 0.45 μm.

Example of Production of Resin Fine Particle 3 Dispersion

A resin fine particle 3 dispersion was prepared as in the production of the resin fine particle 1 dispersion, except that EVOH-A was replaced by EVOH-C. The resulting resin fine particle 3 had a volume median diameter of 0.59 μm.

Example of Production of Resin Fine Particle 4 Dispersion

A resin fine particle 4 dispersion was prepared as in the production of the resin fine particle 1 dispersion, except that EVOH-A was replaced by EVOH-D. The resulting resin fine particle 4 had a volume median diameter of 0.52 μm.

Example of Production of Resin Fine Particle 5 Dispersion

A resin fine particle 5 dispersion was prepared as in the production of the resin fine particle 1 dispersion, except that EVOH-A was replaced by EVOH-E. The resulting resin fine particle 5 had a volume median diameter of 0.55 μm.

Example of Production of Resin Fine Particle 6 Dispersion

A resin fine particle 6 dispersion was prepared as in the production of the resin fine particle 1 dispersion, except that EVOH-A was replaced by EVOH-F. The resulting resin fine particle 6 had a volume median diameter of 0.59 μm.

Example of Production of Resin Fine Particle 7 Dispersion

A resin fine particle 7 dispersion was prepared as in the production of the resin fine particle 1 dispersion, except that the acid group-containing olefin copolymer and N,N-dimethylaminoethanol were not used. The resulting resin fine particle 7 had a volume median diameter of 1.05 μm.

Example of Production of Resin Fine Particle 8 Dispersion

A resin fine particle 8 dispersion was prepared as in the production of the resin fine particle 1 dispersion, except that EVOH-A was replaced by a commercially available ethylene-poval resin "EVOH-G" (Soarnol A4412, manufactured by The Nippon Synthetic Chemical Industry Co., Ltd., monomer unit Y2 content: 67.0 mass %, melting point: 164° C.). The resulting resin fine particle 8 had a volume median diameter of 1.33 μm.

Example of Production of Resin Fine Particle 9 Dispersion

A resin fine particle 9 dispersion was prepared as in the production of the resin fine particle 1 dispersion, except that EVOH-A was replaced by a commercially available ethylene-poval resin "EVOH-H" (Soarnol DC3212, manufactured by The Nippon Synthetic Chemical Industry Co., Ltd., monomer unit Y2 content: 77.0 mass %, melting point: 183° C.). The resulting resin fine particle 9 had a volume median diameter of 1.50 μm.

Example of Production of Resin Fine Particle 10 Dispersion

A resin fine particle 10 dispersion was prepared as in the production of the resin fine particle 1 dispersion, except that EVOH-A was replaced by an ethylene-vinyl acetate copolymer ("EVA-A", content of monomer unit derived from vinyl acetate: 15 mass %, acid value: 0 mg KOH/g, weight-average molecular weight: 110000, softening point (Tm): 128° C., melting point: 86° C., rupture elongation: 700%). The resulting resin fine particle 10 had a volume median diameter of 5.50 μm.

Example of Production of Coloring Agent Fine Particle Dispersion

The following components:

a coloring agent (cyan pigment: Pigment Blue 15:3, manufactured by Dainichiseika Color & Chemicals Mfg. Co., Ltd.): 10.0 parts, an anionic surfactant (NeoGen RK, manufactured by DKS Co., Ltd.): 1.5 parts, and deionized water: 88.5 parts were mixed and dissolved, followed by dispersion with a high-pressure impact disperser Nanomizer (manufactured by Yoshida Kikai Co., Ltd.) for about 1 hour to prepare an aqueous dispersion having a coloring agent fine particle concentration of 10% (coloring agent fine particle dispersion) where the coloring agent was dispersed. The resulting coloring agent fine particles had a volume median diameter of 0.20 μm measured with a dynamic light scattering particle size analyzer (Nanotrac, manufactured by Nikkiso Co., Ltd.).

Example of Production of Aliphatic Hydrocarbon Fine Particle Dispersion

The following components:

an aliphatic hydrocarbon (HNP-51, manufactured by Nippon Seiro Co., Ltd., melting point: 78° C.): 20.0 parts an anionic surfactant (NeoGen RK, manufactured by DKS Co., Ltd.): 1.0 parts, and deionized water: 79.0 parts were put in a mixing container equipped with a stirrer. The mixture was heated to 90° C. and was circulated into Clearmix W-Motion (manufactured by M Technique Co., Ltd.) for dispersion treatment for 60 minutes.

The conditions of the dispersion treatment were as follows:

rotor outer diameter: 3 cm, clearance: 0.3 mm, rotor rotation speed: 19000 r/min, and screen rotation speed: 19000 r/min.

After the dispersion treatment, the dispersed mixture was cooled to 40° C. under cooling treatment conditions of a rotor rotation speed of 1000 r/min, a screen rotation speed of 0 r/min, and a cooling rate of 10° C./min to obtain an aqueous dispersion having an aliphatic hydrocarbon fine particle concentration of 20% (aliphatic hydrocarbon fine particle dispersion). The aliphatic hydrocarbon fine particles had a volume median diameter of 0.15 μm measured with a dynamic light scattering particle size analyzer (Nanotrac, manufactured by Nikkiso Co., Ltd.).

Example of Production of Aliphatic Alcohol Fine Particle Dispersion

An aliphatic alcohol fine particle dispersion was prepared as in the production of the aliphatic hydrocarbon fine particle dispersion except that the aliphatic hydrocarbon was replaced by an aliphatic alcohol (docosanol, manufactured by Tokyo Chemical Industry Co., Ltd., melting point: 68° C.). The resulting aliphatic alcohol fine particles had a volume median diameter of 0.20 μm measured with a dynamic light scattering particle size analyzer (Nanotrac, manufactured by Nikkiso Co., Ltd.).

Example of Production of Silicone Oil Emulsion

The following components:

silicone oil (dimethyl silicone oil KF96-50CS, manufactured by Shin-Etsu Chemical Co., Ltd.): 20.0 parts, an anionic surfactant (NeoGen RK, manufactured by DKS Co., Ltd.): 1.0 parts, and deionized water: 79.0 parts were mixed and dissolved, followed by dispersion treatment with a high-pressure impact disperser Nanomizer (manufactured by Yoshida Kikai Co., Ltd.) for about 1 hour to prepare an aqueous dispersion having a silicone oil concentration of 20% (silicone oil emulsion) where the silicone oil is dispersed. The silicone oil particles in the resulting silicone oil emulsion had a volume median diameter of 0.09 μm measured with a dynamic light scattering particle size analyzer (Nanotrac, manufactured by Nikkiso Co., Ltd.).

Example of Production of Toner 1

The following components:

resin fine particle 1 dispersion: 500 parts, coloring agent fine particle dispersion: 80 parts, aliphatic hydrocarbon fine particle dispersion: 150 parts, silicone oil emulsion: 50 parts, and deionized water: 160 parts were put in a stainless steel round flask and were mixed, and a 10% magnesium sulfate aqueous solution (60 parts) was then added thereto, followed by dispersion treatment with a homogenizer (Ultra-Turrax T50, manufactured by IKA) at 5000 r/min for 10 minutes.

Subsequently, the mixture solution was heated up to 73° C. in a heating water bath with stirring while appropriately controlling the number of rotation of a stirring blade such that the mixture solution was stirred.

After retention at 73° C. for 20 minutes, the resulting aggregated particles had a volume median diameter of about 6.0 μm.

A 5% sodium ethylenediaminetetraacetate aqueous solution (330 parts) was further added to the dispersion including the aggregated particles, followed by heating up to 98° C. with continuously stirring. The dispersion was maintained at 98° C. for 1 hour to fuse the aggregated particles.

Subsequently, crystallization of EVOH-A was accelerated by cooling down to 50° C. and maintaining the temperature for 3 hours. After further cooling down to 25° C., filtration was carried out for solid-liquid separation. The residue was washed with a 0.5% sodium ethylenediaminetetraacetate aqueous solution and further with deionized water.

After completion of the washing, drying with a vacuum dryer was performed to give toner particle 1 having a volume median diameter of 5.4 μm.

Based on 100 parts of toner particle 1, 1.5 parts of hydrophobized silica fine particles having a primary number-average particle diameter of 10 nm and 2.5 parts of hydrophobized silica fine particles having a primary number-average particle diameter of 100 nm were dry-mixed with a Henschel mixer (manufactured by Nippon Coke & Engineering Co., Ltd.) to give Toner 1 having a volume median diameter of 5.4 μm. Table 2 shows the composition of Toner 1.

Example of Production of Toners 2 to 7

Toners 2 to 7 were prepared as in the production of Toner 1 except that resin fine particle 1 was replaced by resin fine particles 2 to 7, respectively. Table 2 shows the volume median diameters and the compositions of Toners 2 to 7.

Example of Production of Toner 8

Toner 8 was prepared as in the production of Toner 1 except that the aliphatic hydrocarbon fine particle dispersion was replaced by the aliphatic alcohol fine particle dispersion. Table 2 shows the volume median diameter and the composition of Toner 8.

Example of Production of Toner 9

Toner 9 was prepared as in the production of Toner 1 except that the aliphatic hydrocarbon fine particle dispersion was not used. Table 2 shows the volume median diameter and the composition of Toner 9.

Example of Production of Toner 10

Toner 10 was prepared as in the production of Toner 1 except that the silicone oil emulsion was not used. Table 2 shows the volume median diameter and the composition of Toner 10.

Example of Production of Toner Comparisons 1 to 3

Toner Comparisons 1 to 3 were prepared as in the production of Toner 1 except that resin fine particle 1 was replaced by resin fine particles 8 to 10, respectively. Table 2 shows the volume median diameters and compositions of Toner Comparisons 1 to 3.

Examples 1 to 10 and Comparative Examples 1 to 3

Toners 1 to 10 and Toner Comparisons 1 to 3 were evaluated by the following tests. The results of the evaluation are shown in Table 3.

Evaluation of Low-Temperature Fixability

A toner was mixed with a ferrite carrier (average particle diameter: 42 μm) having a surface coated with a silicone resin to prepare a two-component developer having a toner concentration of 8 mass %.

An unfixed toner image (0.75 mg/cm$^2$) was formed on image receiving paper (64 g/m$^2$) with a commercially available full-color digital copier (CLC1100, manufactured by CANOAN KABUSHIKI KAISHA). The fixing unit detached from a commercially available full-color digital copier (image RUNNER ADVANCE C5051, manufactured by CANOAN KABUSHIKI KAISHA) was remodeled such that the fixing temperature can be regulated and was used for a fixing test of the unfixed toner image.

At a room temperature of 15° C. and a humidity of 10% RH, the image state when the unfixed toner image was fixed at a process speed of 357 mm/sec was visually evaluated as follows:

A: Fixing is possible at a temperature of 140° C. or less,

B: Fixing is possible at a temperature of higher than 140° C. and 150° C. or less, and C: Fixing is possible at a temperature of higher than 150° C. or is impossible in the whole temperature range.

Evaluation of Hot Offset Resistance

The two-component developer prepared in the "Evaluation of low-temperature fixability" was used.

In the evaluation, an unfixed toner image (0.1 mg/cm$^2$) was formed on image receiving paper (64 g/m$^2$) with a commercially available full-color digital copier (CLC1100, manufactured by CANOAN KABUSHIKI KAISHA). The fixing unit detached from a commercially available full-color digital copier (image RUNNER ADVANCE C5051, manufactured by CANOAN KABUSHIKI KAISHA) was remodeled such that the fixing temperature can be regulated and was used for a fixing test of the unfixed toner image.

At a room temperature of 23° C. and a humidity of 5% RH, the image state when the unfixed toner image was fixed at a process speed of 357 mm/sec was visually evaluated as follows:

A: Hot offset occurs at a temperature of higher than 160° C. or no hot offset occurs until 200° C., B: Hot offset occurs at a temperature of higher than 140° C. and 160° C. or less, C: Hot offset occurs at a temperature of higher than 130° C. and 140° C. or less, and D: Hot offset occurs at a temperature of 130° C. or less.

Evaluation of Charge-Retaining Property

In an aluminum pan is weighed 0.01 g of a toner. The toner was charged to −600 V with a StroColon charging apparatus. Subsequently, the behavior of changing the surface potential was measured for 30 minutes under an environment of a temperature of 30° C. and a humidity of 80% RH with a surface potential meter (manufactured by Trek Japan K.K., model 347).

The charge retention was calculated from the measurement results by the expression:

charge retention (%) after 30 min=(surface potential after 30 min/initial surface potential)×100.

The charge-retaining property was evaluated as follows:

A: a charge retention of 90% or more,

B: a charge retention of 50% or more and less than 90%, and

C: a charge retention of less than 50%.

Evaluation of High-Temperature Storage Stability (Blocking Resistance)

Each toner was left to stand in a thermo-hygrostat at a temperature of 50° C. and a humidity of 54% RH for 7 days and was then visually evaluated for the degree of blocking as follows:

A: No blocking occurs, or even if blocking occurs, the blocking is easily dispersed by slight vibration, B: Blocking occurs, but is dispersed by continuous vibration, and C: Blocking occurs and is not dispersed even if a force is applied.

TABLE 1

| Hydroxyl group-containing olefin copolymer | Melting point (° C.) | Monomer unit Y2 content (mass %) | (l + m)/W | Softening point (Tm) (° C.) |
|---|---|---|---|---|
| EVOH-A | 105 | 8.1 | 1.00 | 120 |
| EVOH-B | 111 | 16.0 | 1.00 | 120 |
| EVOH-C | 95 | 8.1 | 1.00 | 90 |
| EVOH-D | 120 | 8.1 | 1.00 | 155 |
| EVOH-E | 106 | 2.6 | 1.00 | 120 |
| EVOH-F | 104 | 1.6 | 1.00 | 120 |
| EVOH-G | 164 | 67.0 | 1.00 | — |
| EVOH-H | 183 | 77.0 | 1.00 | — |
| (EVA-A) | 86 | — | — | 128 |

TABLE 2

| Toner NO. | Resin fine particle dispersion No. | Toner median diameter (μm) | Hydroxyl group-containing olefin copolymer | Acid group-containing olefin copolymer | Low molecular weight plasticizer | Silicone oil |
|---|---|---|---|---|---|---|
| 1 | 1 | 5.4 | EVOH-A | Included | Aliphatic hydrocarbon | Included |
| 2 | 2 | 5.1 | EVOH-B | Included | Aliphatic hydrocarbon | Included |
| 3 | 3 | 5.2 | EVOH-C | Included | Aliphatic hydrocarbon | Included |
| 4 | 4 | 5.3 | EVOH-D | Included | Aliphatic hydrocarbon | Included |
| 5 | 5 | 5.4 | EVOH-E | Included | Aliphatic hydrocarbon | Included |
| 6 | 6 | 5.3 | EVOH-F | Included | Aliphatic hydrocarbon | Included |
| 7 | 7 | 6.5 | EVOH-A | Not included | Aliphatic hydrocarbon | Included |
| 8 | 1 | 5.2 | EVOH-A | Included | Aliphatic alcohol | Included |
| 9 | 1 | 5.1 | EVOH-A | Included | Not included | Included |
| 10 | 1 | 5.4 | EVOH-A | Included | Aliphatic hydrocarbon | Not Included |
| Comparison 1 | 8 | 7.6 | EVOH-G | Included | Aliphatic hydrocarbon | Included |
| Comparison 2 | 9 | 7.8 | EVOH-H | Included | Aliphatic hydrocarbon | Included |
| Comparison 3 | 10 | 10.5 | Not included (EVA-A used) | Not included | Aliphatic hydrocarbon | Included |

TABLE 3

| | Toner No. | Low-temperature fixability | Hot offset resistance | Charge-retaining property | High-temperature storage stability |
|---|---|---|---|---|---|
| Example 1 | 1 | A | A | A | A |
| Example 2 | 2 | A | A | B | B |
| Example 3 | 3 | A | B | B | A |
| Example 4 | 4 | B | A | A | A |
| Example 5 | 5 | B | B | A | A |
| Example 6 | 6 | B | C | A | A |
| Example 7 | 7 | B | B | B | B |
| Example 8 | 8 | A | A | B | A |
| Example 9 | 9 | B | A | A | A |
| Example 10 | 10 | B | B | A | A |
| Comparative Example 1 | Comparison 1 | C | D | C | A |
| Comparative Example 2 | Comparison 2 | C | D | C | A |
| Comparative Example 3 | Comparison 3 | B | D | A | B |

The present disclosure can provide a toner having excellent low-temperature fixability, hot offset resistance, and charge-retaining property and a method of producing a toner.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-189381 filed Sep. 28, 2016, which is hereby incorporated by reference herein in its entirety.

What is claimed is:

1. A toner comprising a toner particle containing a resin component, wherein:

the resin component contains an olefin copolymer, the olefin copolymer including:

a monomer unit Y1 represented by Formula (1), and a monomer unit Y2 represented by Formula (2);

the content of the olefin copolymer in the resin component being more than 50 mass % based on the total mass of the resin component; and the olefin copolymer having a melting point of 80° C. or more and 150° C. or less, (1)

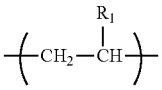

(2)

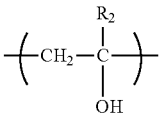

where in Formulae (1) and (2), $R_1$ represents H or $CH_3$; and $R_2$ represents H or $CH_3$.

2. The toner according to claim 1, wherein:

the content of the monomer unit Y2 is 2.0 mass % or more and 20.0 mass % or less based on the total mass of the olefin copolymer.

3. The toner according to claim 1, wherein:

the mass ratio (l+m)/W of the monomer units to the olefin copolymer in the resin component is 0.80 or more, where W denotes the total mass of the olefin copolymer, 1 denotes the mass of the monomer unit Y1 represented by Formula (1), and m denotes the mass of the monomer unit Y2 represented by Formula (2).

4. The toner according to claim 1, wherein:

the olefin copolymer has a softening point of 100° C. or more and 150° C. or less.

5. The toner according to claim 1, wherein:

the resin component further contains an acid group-containing olefin copolymer having an acid value of 50 mg KOH/g or more and 300 mg KOH/g or less.

6. The toner according to claim 1, wherein:

the toner particle contains an aliphatic hydrocarbon, aliphatic alcohol, or aliphatic carboxylic acid having a melting point of 50° C. or more and 100° C. or less.

7. The toner according to claim 1, wherein:

the toner particle contains silicone oil.

8. A method of producing a toner comprising a toner particle containing a resin component, wherein:

the resin component contains an olefin copolymer; and the method comprises preparing a resin fine particle dispersion in which resin fine particles generating the resin component are dispersed in an aqueous medium, wherein the olefin copolymer includes:

a monomer unit Y1 represented by Formula (1), and a monomer unit Y2 represented by Formula (2);

the content of the olefin copolymer in the resin component is more than 50 mass % based on the total mass of the resin component; and the olefin copolymer has a melting point of 80° C. or more and 150° C. or less, (1)

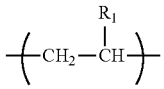

(2)

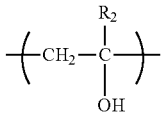

where in Formulae (1) and (2), $R_1$ represents H or $CH_3$; and $R_2$ represents H or $CH_3$.

9. The method of producing a toner according to claim 8, wherein:

the resin component contains an acid group-containing olefin copolymer having an acid value of 50 mg KOH/g or more and 300 mg KOH/g or less.

10. The method of producing a toner according to claim 8, the method further comprising:

after preparing a resin fine particle dispersion, aggregating the resin fine particles to form aggregated particle; and heating the aggregated particles for fusion.

* * * * *